US005868958A

United States Patent [19]

Comisford, Jr.

[11] Patent Number: 5,868,958

[45] **Date of Patent: *Feb. 9, 1999**

[54] BASKET MOLD

[75] Inventor: Charles B. Comisford, Jr., Newark, Ohio

[73] Assignee: The Longaberger Company, Newark, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 430,029

[22] Filed: Apr. 27, 1995

[51] Int. Cl.[6] ..... B22C 9/06

[52] U.S. Cl. ..... 249/117; 249/175

[58] Field of Search ..... 249/117, 175

[56] References Cited

U.S. PATENT DOCUMENTS 450,114 4/1891 Snow ..... 147/48

2,207,596 7/1940 Newill ..... 249/117

FOREIGN PATENT DOCUMENTS 1620076 1/1991 U.S.S.R. ..... 249/117

329097 3/1930 United Kingdom ..... 249/117

*Primary Examiner*—David W. Wu

*Attorney, Agent, or Firm*—Porter, Wright, Morris, & Arthur

[57] ABSTRACT

An apparatus for facilitating the construction of rectangular hand-woven baskets. The apparatus provides a guide, or mold, for shaping the interior of the basket. The mold has a generally rectangular bottom with rounded corners. Four sides extend obliquely from the bottom. The upper ends of the side walls are longer than the lower end of the side walls to allow removal of the finished basket from the mold. Adjacent lateral edges of the side walls join to define rounded corners. A concave indentation is provided in the upper end of the side wall. The indentation is deepest at the lateral center of the upper end of the wall and tapers gradually toward the adjacent corners and the lower portion of the side wall.

15 Claims, 2 Drawing Sheets

BASKET MOLD

BACKGROUND AND SUMMARY OF THE INVENTION

This invention relates generally to molds for use in making hand-woven baskets, and more particularly to improved molds for making rectangular baskets.

Hand-woven baskets, and particularly hand-woven rectangular baskets, are often made using a two-step process in which the basket bottom panel is formed separately from the side panels. The bottom panel is constructed in the first, or "forming" step, and the side panels are constructed, with the aid of a basket mold, in the second, or weaving step.

The bottom panel comprises a rectangular woven center with unwoven splint ends projecting outwardly from all sides of the center. The woven center will form the bottom of the basket and the unwoven splint ends will form the vertical structure of the side walls. The basket bottom panel may be formed by selecting weaving splints that are at least twice the desired height of the basket side walls plus the length or width of the basket, depending upon the intended orientation of the splint relative to the basket bottom. Certain of the weaving splints, referred to as cross splints, are arranged in parallel relationship to one another on a work table or other flat surface. Each cross splint is transversely spaced from an adjacent splint, although the spacing may vary with the basket design. Fill splints may be inserted between the cross splints, if desired, to aid in the spacing of the cross splints and to provide a more solid basket bottom by reducing the size of the gaps that otherwise would be present between the cross splints in the bottom panel. The fill splints do not extend beyond the edges of the basket bottom and do not form any part of the vertical structure of the side panels of the basket.

Other weaving splints, referred to as up splints, are oriented perpendicularly to the cross splints. As with the cross splints, the up splints are generally arranged in spaced parallel relationship with one another, although the spacing may vary with the basket design. The up splints are woven through the cross splints in a desired pattern. An alternating over-and-under pattern commonly is used, although other weave patterns also may produce satisfactory results. The weaving continues until the woven center attains the shape and dimensions desired for the basket bottom. As described above, however, the weaving is limited to the center sections of the splints, leaving unwoven splint ends extending from each side of the woven center. Reinforcement splints may be added to the woven center of the panel to strengthen the basket bottom, provide a base to which the woven splints may be secured, and give the basket a more finished appearance.

When the center of the bottom panel has been woven to its desired size, the weaving splints (and any reinforcements used) usually are secured together to prevent disturbance of the arrangement of the splints during transfer of the bottom panel to a basket mold and positioning of the bottom panel on the mold. Preferably, this is accomplished using fasteners such as tacks, although other suitable methods of securing the bottom panel components also may be used. After the weaving splints have been secured to one another and to any reinforcements, the panel may be lifted from the work surface.

In the second step of basket construction, the formed bottom panel is transformed into a finished basket with the aid of a basket mold. The mold has a generally rectangular bottom with rounded corners. Four generally planar walls extend obliquely from the mold bottom. Adjacent lateral edges of the side walls define corners, which are rounded to reduce stress on the weaving materials as they are conformed to the basket mold. The upper ends of the side walls are longer than the lower ends to allow removal of the finished basket from the mold; however, the difference in size between the upper and lower ends may vary depending on whether the desired basket design has relatively vertical sides or sides that incline outwardly. The upper ends of the side walls on a mold used for making a basket with a level top rim may be substantially parallel to the lower wall ends, while the upper ends of the side walls on a mold used for making a basket with a sloping top rim may be angled relative to the lower wall ends.

The mold bottom and sides are sized and shaped to correspond to the desired shape of the basket interior. For example, a basket having a square base, outwardly inclined sides and a square top rim that is substantially larger than the base would be constructed using a mold having a square base and outwardly inclined side walls whose upper ends are substantially larger than their lower ends. Similarly, a basket having a rectangular base, relatively straight side walls and a rectangular top rim that is only slightly larger than the base would be constructed using a mold having a rectangular base and relatively straight side walls whose upper ends are only slightly larger than their lower ends.

The mold also may have a top connected to the upper ends of the side walls. The shape of the top does not affect the shape of an open-top basket. The top of the mold may include a spindle-receiving recess that extends into the body of the mold to allow the mold to be supported on a spindle during weaving. The spindle may be connected to a weaving stand, or "horse," to facilitate rotation of the mold and the partially constructed basket during the weaving step. Advantageously, the horse can support the mold in a generally upright position and a generally horizontal position to allow the weaver to vary the position of the mold.

An inner top band, which defines the top edge or rim of the basket, is wrapped around the mold along the upper edges of the side walls. The inner band may be secured in this position by clips attached to the mold, by a fastener inserted through overlapping portions of the band, or both.

The bottom panel is placed in association with a basket mold, with the woven center of the panel overlaying and aligned with the bottom of the mold. The basket is formed over (not inside) the mold such that the surface of the bottom panel that is next to the mold will comprise the interior of the basket and the opposing surface will comprise the exterior of the basket. The bottom panel is clamped to the mold to prevent the panel from shifting relative to the mold when the mold is manipulated during weaving of the side panels. The weaving splints are bent around the mold to conform substantially to the side walls of the mold, with the ends of the splints near the top edge of the mold sides.

The side panels of the basket are constructed by weaving strips through the splint ends, usually beginning next to the woven center of the bottom panel and working toward the ends of the weaving splints. The weaving strips are drawn tight against the mold such that the weaving splints remain in close conformance to the side walls of the mold. When the side panels have reached the desired height, the ends of the weaving splints are trimmed as close as possible to the upper edge of the inner band. An outer top band may be wrapped over the splint ends in substantially overlaying relationship to the inner top band. The splint ends are secured to the bands by fasteners or the like, and the completed basket is lifted from the mold. Preferably, both inner and outer top bands are used to create finished appearance and provide a stronger basket. However, it also may be possible to construct a useful basket with only a single top band.

Ideally, the size and shape of the interior of a completed basket would conform closely to the size and shape of the basket mold on which the basket was formed. For example, the interior of a basket formed on a mold having a rectangular top rim and planar sides would have a rectangular top rim and planar sides, with the preferred shape of the basket being approximated by straight lines drawn between the corners of the mold. However, when rectangular baskets are constructed of pliable materials, such as wood, on molds with planar sides, the baskets relax after they are removed from their molds, causing the side panels of the baskets (and particularly the upper side panels of the baskets) to bow outwardly.

This bowing, which may be observed, for example, in high-quality, tightly woven wooden baskets, causes the finished baskets to deviate unacceptably from the desired shape of the basket in which the top rim closely approximates a rectangle. The tendency of the basket sides to bow outwardly is most noticeable as the length of the side panel increases. Baskets having outwardly bowed sides may be considered less attractive than baskets with crisp, straight sides.

When a rectangular article, such as a box, casserole dish, or molded plastic basket protector, is placed inside of a basket with bowed sides, unsightly gaps remain between the object and the outwardly bowed upper side walls of the basket. These gaps emphasize the nonideal, bowed shape of the basket sides. The gaps also increase the risk that items being transferred into and out of the basket may be dropped or spilled between the basket and the insert, decreasing the effectiveness of a molded plastic basket protector or other basket insert in protecting the basket interior from contact with the basket contents.

In addition, basket lids, which may include flat bottomed panels that rest on the top rim of the basket, or lids with a neck that fits within the inner band and a lip that projects transversely from the neck and rests on the top rim, are a decorative and functional basket accessory. Successful use of a lid, however, requires a good fit between the lid and the basket top rim. The irregular bowing of the basket side walls increases the difficulty and expense of fitting lids to hand-woven baskets.

In light of the disadvantages of the prior art, an apparatus is needed that can facilitate construction of rectangular baskets with a rectangular top rim and straight, unbowed sides.

Accordingly, it is an object of the present invention to provide an apparatus for assisting in the construction of rectangular baskets that have straighter sides than baskets constructed using known molds.

A second object of the present invention is to provide an apparatus for assisting in the construction of hand-woven baskets with a more nearly rectangular top opening than baskets constructed using known molds.

A third object of the present invention is to provide an apparatus for assisting in the construction of baskets that conform more closely to the shape of rectangular articles inserted into the baskets.

Another object of the present invention is to provide a mold for baskets in which the side walls of the mold do not conform to the desired contours of the side walls of the basket.

The foregoing objectives are achieved in an apparatus for facilitating the construction of hand-woven rectangular baskets. The invention includes a mold having a generally rectangular bottom with rounded corners. Four sides extend obliquely from the bottom. The upper ends of the side walls are longer than the lower end of the side walls to allow removal of the finished basket from the mold. Adjacent lateral edges of the side walls join to define rounded corners. A concave indentation is provided in the upper end of the generally planar side wall. The indentation is deepest at the lateral center of the upper end of the wall and tapers gradually toward the adjacent corners and the lower portion of the side wall.

These and further objects of the invention will become apparent from the following detailed description.

DETAILED DESCRIPTION OF THE PREFERRED EMBODIMENT(S)

Figure 1:
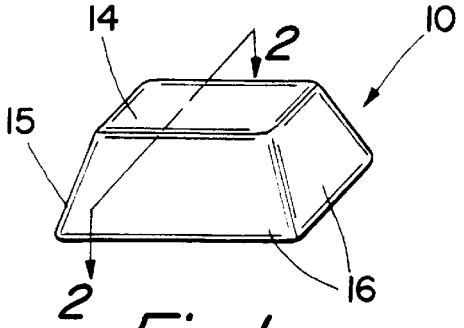
Fig. 1 (PRIOR ART)
FIG. 1 is a perspective view of a known basket mold in an inverted position.
Figure 2:
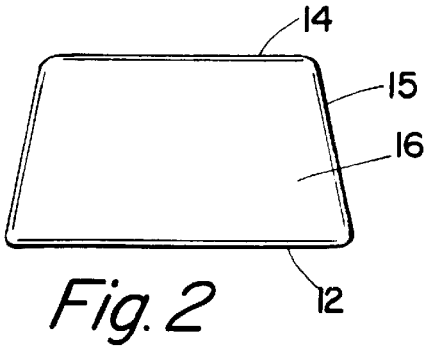
Fig. 2 (PRIOR ART)
FIG. 2 is a sectional view of the basket mold of FIG. 1 along lines 2—2.

A basket mold 10 of the type traditionally used to make open-top rectangular woven wooden baskets is shown in FIG. 1. The mold includes a generally rectangular bottom 14 and sides 16 extending obliquely from the bottom 14. The shape of the bottom 14 and sides 16 generally corresponds to the desired shape of the interior of the basket. The lateral edges of the sides 16 intersect at rounded corners 15. As shown in FIGS. 1–2, the sides 16 are generally planar from their lower ends to their upper ends and from one lateral end to another.

The mold 10 also has a top 12 connected to the upper ends of the sides 16. The shape of top 12 of the mold does not affect the shape of the basket, because the sides of the open-top basket will end at the upper edges of the mold sides. However, as described above, the top 12 may include a spindle-receiving recess 17.

Figure 3:
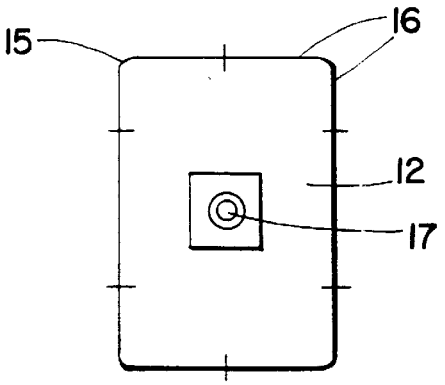
Fig. 3 (PRIOR ART)
FIG. 3 is a top plan view of the basket mold of FIG. 1.
Figure 4:
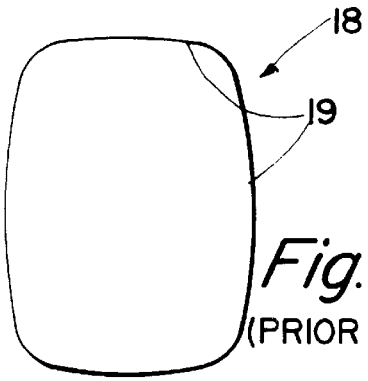
Fig. 4 (PRIOR ART)
FIG. 4 is a diagrammatical top plan view of a rectangular basket constructed using the basket mold of FIG. 1.

FIG. 4 is a diagrammatical top plan view of a rectangular basket 18 constructed using a mold of the type shown in FIGS. 1–3. As described above, the sides 19 of the basket 18 bow outwardly and the top rim does not have the preferred rectangular shape.

Figure 5:
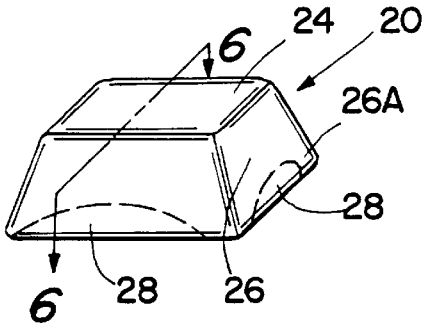
FIG. 5 is a perspective view of the basket mold of the present invention in an inverted position.

FIG. 5 shows a basket mold 20 of the present invention. The mold includes a generally rectangular bottom 24 and sides 26 extending obliquely from the bottom 24. The lateral edges of the sides 26 intersect at rounded corners 25.

The mold 20 also has a top 22 connected to the upper ends of the sides 26 in substantially opposing relationship to the bottom 24. The shape of top 22 of the mold does not affect the shape of the basket, because the sides of the open-top basket will terminate at the upper edges of the sides. The top 22 may include a spindle-receiving recess 27 for supporting the mold during weaving, as described above.

Figure 6:
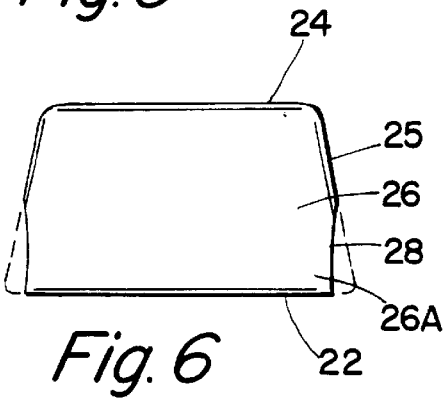
FIG. 6 is a sectional view of the basket mold of FIG. 5 along lines 6—6.
Figure 7:
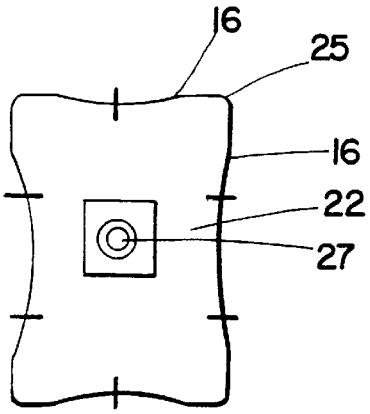
FIG. 7 is a top plan view of the basket mold of FIG. 5.
Figure 8:
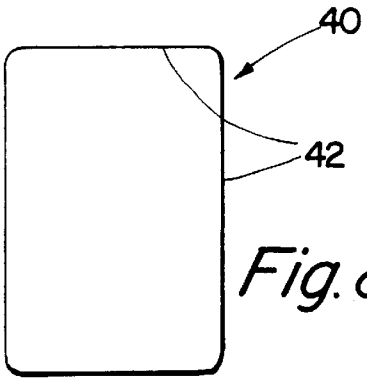
FIG. 8 is a diagrammatical top plan view of a rectangular basket constructed using the basket mold of FIG. 5.

In contrast to the sides 16 of the mold 10, the sides of the mold 20 are not generally planar. The shape of the bottom 22 and sides 26 of the mold 20 correspond roughly to the desired shape of the basket, but the sides 26 of the mold 20 conform less closely to the desired shape of the basket interior compared to the sides 16 of the mold 10. As shown in FIGS. 5–7, the upper portions 26A of the generally planar sides 26 have a concave indentation 28 formed therein. The desired shape of the basket is approximately the shape that would be formed by drawing the shortest possible line between the upper corners 25 of the mold 20. FIG. 8 is a diagrammatical top plan view of a basket 40 constructed using a basket mold 20 of the present invention. The sides 42 of the basket 40 are straighter than those of the basket 18 of FIG. 4, and its top rim is more rectangular.

Figure 11:
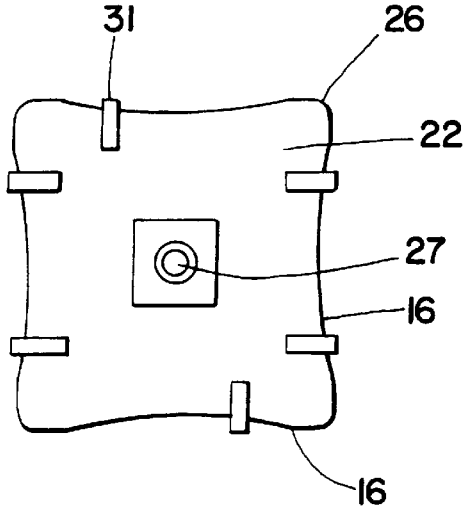
FIG. 11 is a top plan view of another embodiment of the basket mold of the present invention.

Preferably, each indentation 28 is laterally symmetrical across a side panel, and the indentations 28 on opposite sides of the mold 20 are equal to provide the symmetry desired in a completed basket, as shown in FIG. 11, which has sides of equal length. If the sides of the basket are not equal in length, as shown in FIG. 7, the indentations on nonopposing sides may be unequal.

The location and depth of the indentation 28 in the mold 20 that is necessary to result in a basket 40 having straight sides and a rectangular top rim depends on such factors as the type of wood used to make the basket, the amount of moisture in the wood, and the dimensions of the basket (the longer the basket side, the greater the concavity required to achieve the desired result). A shallow indentation 28, such as that shown in FIG. 7, generally will be sufficient to produce the desired result. The indentation 28 must be shallow enough that the corners of the basket components, and particularly the corners of the top band, are not subjected to undue stress, which may result in damage to the basket. The indentation 28 also must be shallow enough that a finished basket that has been tightly woven over the mold 20 may be removed without damage to the basket, although stress to the top band is more likely to be the limiting factor.

Figure 9:
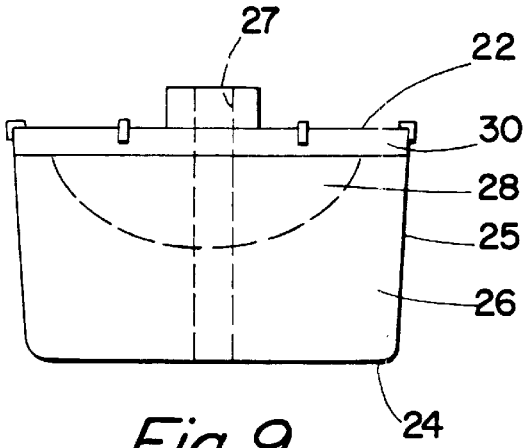
FIG. 9 is a front elevational view of the basket mold of FIG. 5.
Figure 10:
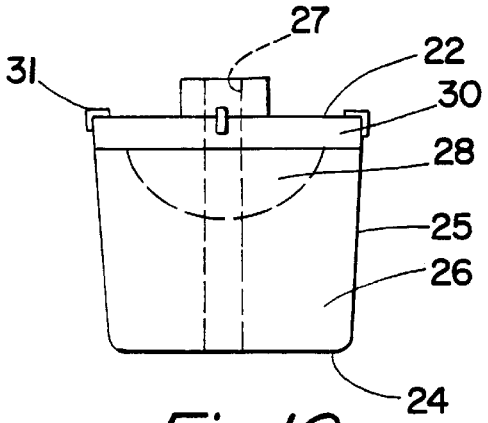
FIG. 10 is a side elevational view of the basket mold of FIG. 5.

The indentation 28 is deepest along the top edge of the wall 26 near its lateral center, and tapers gradually toward the planar surface of the wall 26 toward the adjacent corners 25 and the lower end of the wall 26. Advantageously, portions of the side wall 26 adjacent to the upper corners 25 remain unindented to provide a smooth transition between the outwardly curved corners 25 and the inwardly curved indentations 28, reducing the stress exerted on a basket top band applied to this region of the mold 20. The downward extent of an indentation 28 depends on the height of the side walls and the depth of the indentation. For example, when deeper indentations are provided on the longer sides of a basket mold and shallower ones are provided on the shorter sides (see FIG. 7), the deeper indentations extend further downward than the shallower ones, as shown in FIGS. 9 and 10. By way of example, the maximum indentations on a basket mold that measures approximately 11¾ inches by 15 inches by 10⅜ inches may be ¼ inch and ⅜ inches, respectively. The shallower indentation may taper downwardly to about 3¾ inches from the top of the mold, while the deeper indentation may taper downwardly a distance of about 4½ inches from the top. Other depths and tapers also may yield the desired result, provided, however, that the indentations are not deep enough to damage the basket components when they are wrapped tightly around the mold corners 25.

The mold 20 may be made from a durable material including wood, metal, plastic, or a combination of these, although wood generally is the preferred material for the surface of the mold corresponding to the side wall panels for making wooden baskets because the wooden weave materials are less likely to slip on a wood surface. The sides 26 of the mold 20 may include surface discontinuities, including without limitation lattice-like or ribbed structures, provided that the overall contour of the sides conforms to the description above. A puncture-resistant protective strip 30 of metal or another suitable material may be provided along the upper edges of the side walls 26 in the area beneath the preferred location of the inner band. The strip 30 provides a suitable base for tacking the splints to the top bands without damage to the mold 20.

Figure 12:
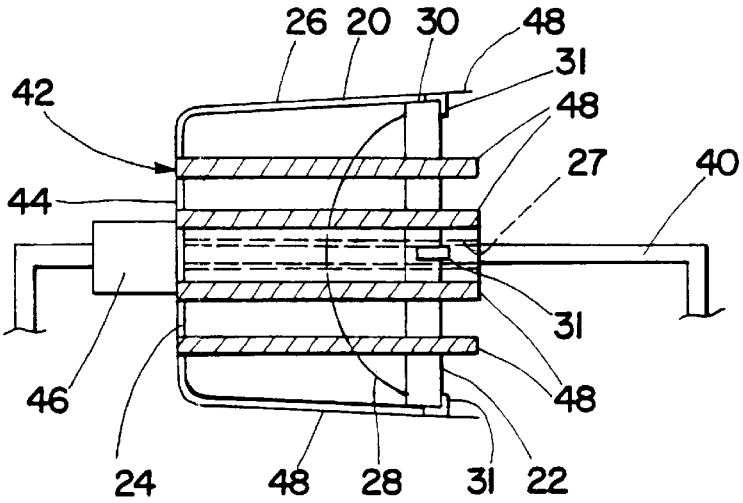
FIG. 12 is a diagrammatical side elevational view of the basket mold of the present invention supported on a spindle in a horizontal position, showing the relationship between the basket mold and the basket bottom panel.

The mold 20 may be used as follows. The top of the mold may be supported on a spindle 40 or other support if desired, as shown in FIG. 12. The inner top band is wrapped around the upper edges of the mold side walls 26 and secured in this position by clips 31 as described above. A formed basket bottom panel 42 is overlaid on the mold 20 with the woven center 44 aligned with the mold bottom 24 and is secured to the mold 20 by a clamp 46. The mold 20 may be inverted on its spindle 40 to facilitate the proper positioning of the bottom panel 42. The ends of the weaving splints 48 projecting from the woven center 44 are bent around the mold 20 to conform substantially to the sides 26.

The side panels of the basket are constructed by weaving strips through the splints, usually beginning next to the woven center of the bottom panel and working toward the free ends of the weaving splints, using the mold to guide the shape of the basket walls. An alternating, over-an-under pattern commonly is used, although other weave patterns also may produce satisfactory results. If desired, colored splints or weave strips may be used to create a desired pattern. The width of the weave strips also may be varied if desired. The weave strips are pulled tightly to maintain the weaving splints substantially in conformance with the mold, and particularly with the recessed portions of the mold in the upper ends of the mold sides. Rows of horizontal weave strips are added until the side walls have reached a desired height in the area of the inner top band. A side wall panel that overlays a concave mold wall will appear to bow slightly inwardly compared to a side wall panel on a known mold with substantially planar sides.

The splint ends are trimmed as close as possible to the upper edge of the inner band. An outer top band is wrapped over the splint ends in substantially overlaying relationship with the inner band, such that the ends of the weaving splints are sandwiched between the inner band and the outer band. The splint ends are secured to the bands, preferably using fasteners such as tacks, although other securing methods, such as rivets or adhesives, also may be used. The basket will have greater structural integrity and durability if each splint is secured to the band, although the basket may still perform its desired function if one or more of the splints remains unsecured.

After the basket is completed, it is removed from the mold. When this is done, the top of the basket pulls outwardly from the concave shape imparted by the mold to assume a generally rectangular shape. The top rim of the basket defines a shape that more nearly approximates a true rectangle than the top rim of a basket constructed using a known mold, as shown in FIGS. 3 and 7.

Although a specific embodiment of the invention has been described herein in detail, it is understood that variations may be made thereto by those skilled in the art without departing from the spirit of the invention or the scope of the appended claims.

What is claimed is:

1. A mold for making a basket with a rectangular top rim, comprising:

a bottom;

a side wall extending obliquely from said bottom and having a concave indentation in its upper end.

2. The mold of claim 1, wherein said indentation is deepest at the lateral center of the upper end of said wall.

3. The mold of claim 2, wherein said indentation tapers toward the lower end of said wall.

4. The mold of claim 3, wherein said side wall has lateral ends and said indentation tapers from the center of the upper wall toward the lateral ends.

5. The mold of claim 1, wherein the upper end of said side wall is longer than the lower end of said side wall.

6. The mold of claim 1, wherein the indentation includes a deep portion in the area of the mold corresponding to the top rim of the basket.

7. The mold of claim 1, further comprising:

a second side wall opposite said first side wall, said second side wall extending obliquely from said bottom and having a concave indentation in its upper end.

8. The mold of claim 7, further comprising:

third and fourth side walls extending obliquely from said bottom, said third and fourth side walls each having a concave indentation in its upper end.

9. The mold according to claim 8, wherein said indentations cause the basket formed on the mold temporarily to have concave sides, said basket relaxing to form a rectangular basket with unbowed sides after the basket is removed from the mold.

10. The mold according to claim 8, wherein said mold causes a basket formed thereon to exhibit a reduced tendency toward outwardly bowing basket sides.

11. The mold according to claim 1, wherein said indentation allows the side of a basket adjacent thereto to be drawn into a concave shape in conformance with said indentation while the basket is in engagement with the mold.

12. The mold according to claim 11, wherein the side of the basket adjacent to said indentation relaxes after the basket is removed from the mold to yield an unbowed basket side.

13. The mold according to claim 1, wherein said indentation causes the basket side adjacent thereto to be shorter than if the mold had a planar side wall, said shorter basket side having a reduced tendency to bow outwardly when the basket is released from the mold.

14. The mold according to claim 1, wherein said mold causes the side of the basket adjacent to the indentation to exhibit a reduced tendency toward outward bowing after the basket is removed from the mold.

15. A mold for making a basket with a rectangular rim, comprising a bottom;

a side wall extending obliquely from said bottom and laterally between opposing corners, the upper end of said side wall being longer than its lower end, said wall having a concave indentation in its upper end; said indentation being deepest at the lateral center of the upper end of said wall and tapering toward said corners and toward the lower end of said wall.

* * * * *